US009016687B2

(12) United States Patent
Ward et al.

(10) Patent No.: US 9,016,687 B2
(45) Date of Patent: Apr. 28, 2015

(54) TAG STACKING SYSTEM AND STACK TRAY AND METHOD OF MAKING AND HANDLING TAGS

(75) Inventors: Donald J. Ward, Sayre, PA (US); Pieter-Jan N. Nijs, NT (HK)

(73) Assignee: Avery Dennison Corporation, Glendale, CA (US)

( * ) Notice: Subject to any disclaimer, the term of this patent is extended or adjusted under 35 U.S.C. 154(b) by 687 days.

(21) Appl. No.: 12/277,581

(22) Filed: Nov. 25, 2008

(65) Prior Publication Data

US 2010/0129189 A1 May 27, 2010

(51) Int. Cl.

| | |
|---|---|
| ***B65H 31/20*** | (2006.01) |
| ***B65H 31/26*** | (2006.01) |
| ***B65H 31/10*** | (2006.01) |
| ***B26D 7/32*** | (2006.01) |
| ***B65H 31/22*** | (2006.01) |

(52) U.S. Cl.

CPC *B26D 7/32* (2013.01); *B65H 31/26* (2013.01); *B65H 2601/252* (2013.01); *B65H 2402/41* (2013.01); *B65H 2401/213* (2013.01); *B65H 31/10* (2013.01); *B65H 2402/5154* (2013.01); *B65H 2701/192* (2013.01); *B65H 31/22* (2013.01)

(58) Field of Classification Search

USPC ..... 271/220, 121, 217, 224

See application file for complete search history.

(56) References Cited

U.S. PATENT DOCUMENTS

| | | | | | |
|---|---|---|---|---|---|
| 3,617,053 | A | * | 11/1971 | Menard | 271/279 |
| 3,897,052 | A | * | 7/1975 | Turman et al. | 271/188 |
| 4,034,846 | A | * | 7/1977 | Burgis et al. | 414/788.9 |
| 4,488,653 | A | * | 12/1984 | Belokin | 211/184 |
| 4,623,291 | A | * | 11/1986 | Buck | 414/788.3 |
| 4,752,174 | A | * | 6/1988 | Nettleton et al. | 414/789.1 |
| 4,792,051 | A | * | 12/1988 | Miller | 211/184 |
| 5,114,136 | A | * | 5/1992 | Miyoshi et al. | 271/213 |
| 5,207,418 | A | * | 5/1993 | Oakes et al. | 271/212 |
| 5,439,209 | A | * | 8/1995 | Runzi | 271/251 |
| 5,537,195 | A | * | 7/1996 | Sagara et al. | 399/381 |
| 5,803,631 | A | * | 9/1998 | Bingham et al. | 400/624 |
| 5,992,324 | A | * | 11/1999 | Rombult et al. | 101/477 |
| 6,257,571 | B1 | * | 7/2001 | Kniss et al. | 271/181 |
| 6,721,060 | B1 | | 4/2004 | Kawamura et al. | |
| 6,918,733 | B2 | * | 7/2005 | Neuber et al. | 414/426 |
| 7,036,816 | B2 | * | 5/2006 | Abe | 271/171 |
| 7,125,182 | B2 | | 10/2006 | Campbell et al. | |
| 7,156,799 | B2 | * | 1/2007 | Abramson et al. | 493/476 |
| 7,237,969 | B2 | * | 7/2007 | Bartman | 400/646 |
| 7,395,938 | B2 | * | 7/2008 | Merit et al. | 211/59.4 |

(Continued)

FOREIGN PATENT DOCUMENTS

| | | | |
|---|---|---|---|
| EP | 0942334 | A1 | 9/1999 |
| EP | 1308779 | A2 | 5/2003 |
| WO | 2008137472 | | 11/2008 |

*Primary Examiner* — Michael McCullough

*Assistant Examiner* — Howard Sanders

(74) *Attorney, Agent, or Firm* — Avery Dennison Retail Information Services LLC

(57) ABSTRACT

There is disclosed a printer and a stacking system to receive and stack tags. The stacking system includes a tag stacker and a removable tag-receiving tray to facilitate transferring a stack of tags from the tag stacker to the place where the tags are to be used. A method of handling tags involves the provision of at least first and second removable trays wherein a first tray with a stack of tags can be replaced by an empty second tray so that the stacking of additional tags can recommence without waiting for the first tray to be emptied.

7 Claims, 7 Drawing Sheets

(56) References Cited

U.S. PATENT DOCUMENTS

| | | | | |
|---|---|---|---|---|
| 7,478,808 | B2 * | 1/2009 | Bernard et al. | 271/248 |
| 7,628,395 | B2 * | 12/2009 | Shiga et al. | 271/145 |
| 7,694,959 | B2 * | 4/2010 | Shimazu et al. | 271/171 |
| 7,792,711 | B2 * | 9/2010 | Swafford et al. | 705/28 |
| 7,913,861 | B2 * | 3/2011 | Mueller et al. | 211/59.3 |
| 2006/0147242 | A1 * | 7/2006 | Blanchard et al. | 400/613 |
| 2007/0248396 | A1 | 10/2007 | Blanchard, Jr. et al. | |
| 2009/0255891 | A1 * | 10/2009 | Lanning | 211/183 |
| 2010/0129130 | A1 * | 5/2010 | Ward | 400/621 |

* cited by examiner

TAG STACKING SYSTEM AND STACK TRAY AND METHOD OF MAKING AND HANDLING TAGS

CROSS-REFERENCE TO RELATED PATENT DOCUMENTS

U.S. Pat. No. 7,125,182 and U.S. patent application Ser. No. 11/409,803 are incorporated herein by reference in their entireties.

BACKGROUND

1. Field

The disclosure is to tag stacking systems and stack trays and method of making and handling tags.

2. Brief Description of the Prior Art

The following U.S. patent documents are made of record: U.S. Pat. No. 7,125,182 and U.S. patent application Ser. No. 11/409,803.

SUMMARY

An embodiment relates to an improved stacking system for a printer and to trays for stacks of tags. As the printer operates, tags can accumulate in a removable tray in the stacker. When the desired number of tags has accumulated in the tray, the printer can be stopped or interrupted and the tray can be removed. An empty tray can be inserted into the stacker and the printer can resume printing. In the meantime, the tray containing the accumulated stack of tags can be taken to a location where the tags are to be used, and so on. It is clear that by use of one or more trays the overall output of the printer can be increased.

An embodiment of a method of handling tags, comprises providing at least first and second removable trays insertable and positionable in a tag stacker, inserting the first tray in the tag stacker, feeding tags into the first tray in the tag stacker, interrupting the feeding of tags, removing the first tray from the tag stacker, inserting and positioning the second tray in the tag stacker, and feeding tags into the second tray in the tag stacker. The method can start out by providing a roll of a printable web, printing on the web on one or both sides of the web, and severing the web into separate tags. Alternatively, printed tags can be provided in the form of a roll of a tag web and the tags can be severed from the tag web.

An embodiment of the disclosure includes a stacking system comprising a stacker having a platform, a tray removably supported on the stacker, the tray including an upstanding rear panel and a bottom panel connected to the rear panel, the bottom panel being capable of being supported on the platform, the bottom panel being capable of accumulating a stack of tags, wherein the tray can include a side panel toward which the tags can be fed, wherein the side panel is spaced from a side wall of the stacker, wherein the side panel can be adjustably positionable and attached to the rear panel, and the side panel is manually movable toward and away from the side wall, and wherein the side panel can be magnetically attached to the rear panel. A tag hold-down device can be repositionably attached to one or both of the side and rear panels. The tag hold-down device is preferably magnetically attached to one or both of the side and rear panels.

The embodiment of the stacking system comprises a stacker having a side panel toward which tags can be fed, the side panel being magnetically attached and repositionable to accommodate tags of different lengths.

The embodiment of a stack tray comprises a rear panel, a bottom panel connected to the rear panel, the bottom panel being capable for supporting a stack of tags, a side panel selectively repositionable with respect to the rear panel, wherein the rear panel is comprised of magnetically responsive material, and a magnet on the side panel enabling the side panel to be magnetically attached to the rear panel at a selected position. A hold-down device can be magnetically attached to one or both of the side and rear panels to retain the stack of tags between the bottom panel and the hold-down device.

BRIEF DESCRIPTION OF THE DIAGRAMMATIC DRAWINGS

DETAILED DESCRIPTION OF THE PREFERRED EMBODIMENTS

Figure 1:
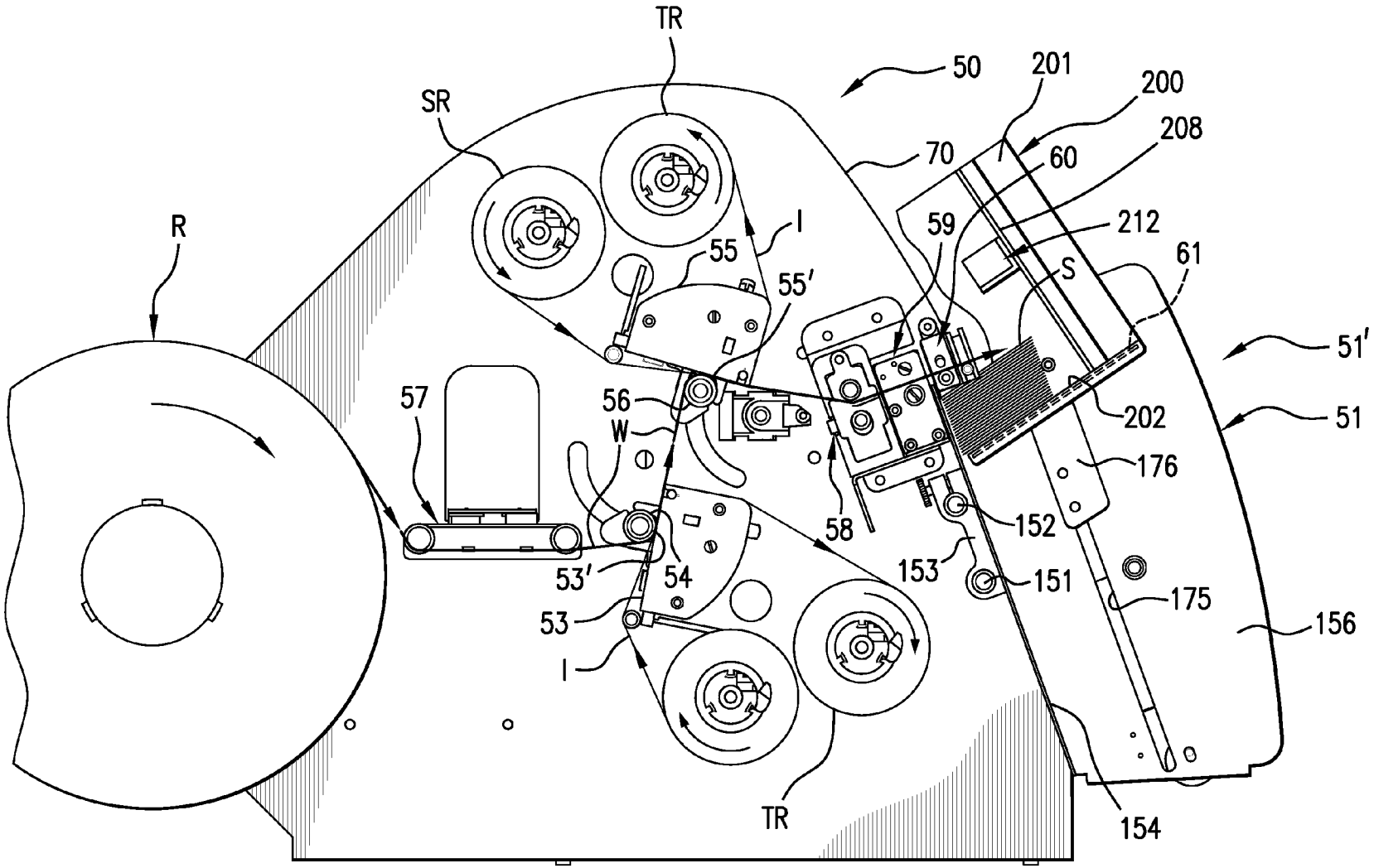
FIG. 1 is an elevational view of a printer and a stacking system including a stacker with a stack tray.

With reference to FIG. 1, there is illustrated a printer generally indicated at 50 for printing on a printable web W and a stacker generally indicated at 51. The printer 50 and the stacker 51 are disclosed in greater detail in U.S. Pat. No. 7,125,182. Where possible the same reference characters are used herein as in U.S. Pat. No. 7,125,182. Alternatively, the printer 50 can have components arranged differently as for example in U.S. application Ser. No. 11/409,803 wherein the path of travel of the web W is somewhat different. The web W is in the form of a roll R can pass beneath a guide mechanism 57. Then the web W can pass between a platen roll 54 and a print head 53' of a print head assembly 53 where the underside of the web W can be printed. From there the web can pass between a platen roll 56 and a print head 55' of a print head assembly 55 where the top side of the web W can be printed. The platen roll 56 may be a driven roll. From there the fully printed web W can pass to an auxiliary feed mechanism 58 which can feed the web W to a cutter mechanism 59 which cuts the web W into predetermined length sheets, in particular tags T. The expression "tags" as used herein is intended to apply to paper and plastic tags, paper and fabric labels and other types of record members because all of such tags and labels can be handled by the printer 50 and the stacking system 51'. The tags T are feed to a feed mechanism 60 which feeds the tags T onto a platform 61 of the stacker 51. The feed mechanism 60 is close to the cutter mechanism so that control of the cut-off tag T is maintained. The feed mechanism 60 can be considered to be part of the printer 50, because the feed mechanism 60 feeds the tags T out of the printer 50, or to be part of the stacker 51 because the feed mechanism 60 feeds the tag T onto the platform 61.

The printer 50 can be of the thermal transfer type wherein ink ribbon I can be advanced from a supply roll SR to a take-up roll TR for both print heads 53' and 55'.

The stacker 51 is mounted to a frame plate 70. Shafts 151 and 152 are cantilevered to the frame plate 70 and pass through a bracket 153 attached to a wall 154 which may be referred to as a side wall. By loosening a thumb screw 155, the stacker 51 can be adjusted laterally or transversely of the printer 50 toward and away from the plane of the frame plate 70.

The stacker 51 is illustrated as including the platform 61 which has a depending mounting member 176 secured to a slide (not shown) by screws 176' passing through a slot 175 in a rear wall 156. The platform 61 can be raised and lowered by a motor-driven pulley system (not shown). As the motor-driven feed roll 95 of the feed mechanism 60 feeds tags T into space within the stacker above the platform 61, the platform 61 is lowered.

Figure 4:
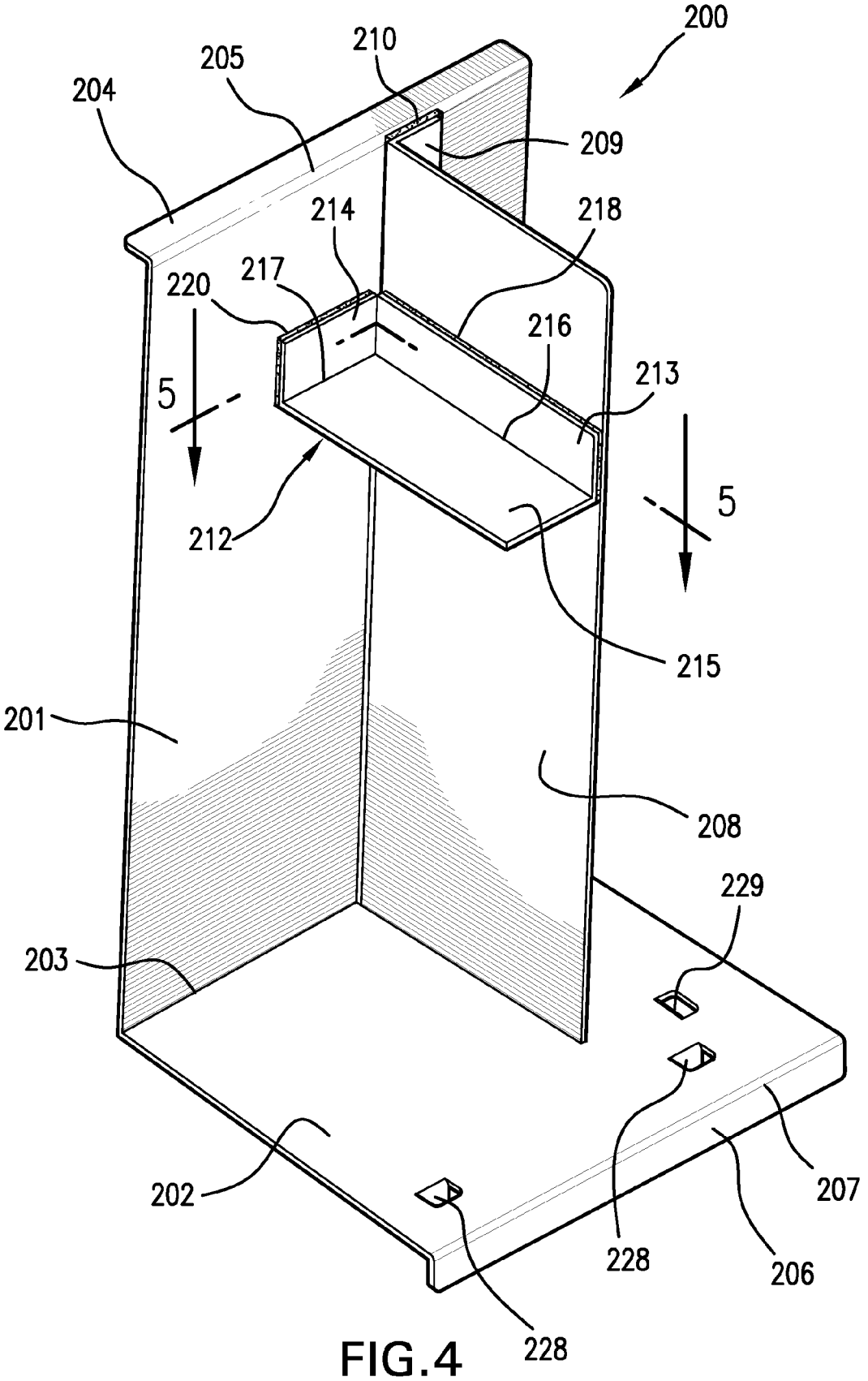
FIG. 4 is a pictorial view of the stack tray and a hold-down device also shown in FIGS. 1 and 2 for example.

With reference to FIG. 4, the stack tray generally indicated a 200 is shown to have an upstanding rear panel or wall 201 which is preferably formed integrally with a bottom panel or base panel 202. The rear and bottom panels 201 and 202 are preferably made by bending a piece of sheet metal at a bend line 203. The rear panel 201 preferably has a flange 204 made by bending the sheet metal along a bend line 205. The bottom panel preferably has a flange 207 made by bending the sheet metal along a bend line 207. The angle between the rear panel 201 and the bottom panel 202 is preferably a right angle. The rear panel 201 and the bottom panel are in an L-shaped configuration. Likewise, the angle of the flange 204 to the rear panel 201 is preferable a right angle, and the angle of the flange 206 to the bottom panel 202 is preferably a right angle. The flange 204 adds stiffness to the rear panel 201 and the flange 206 adds stiffness to the bottom panel 202.

The stacker 51 and the tray 200 form part of a stacker system 51'.

Figure 5:
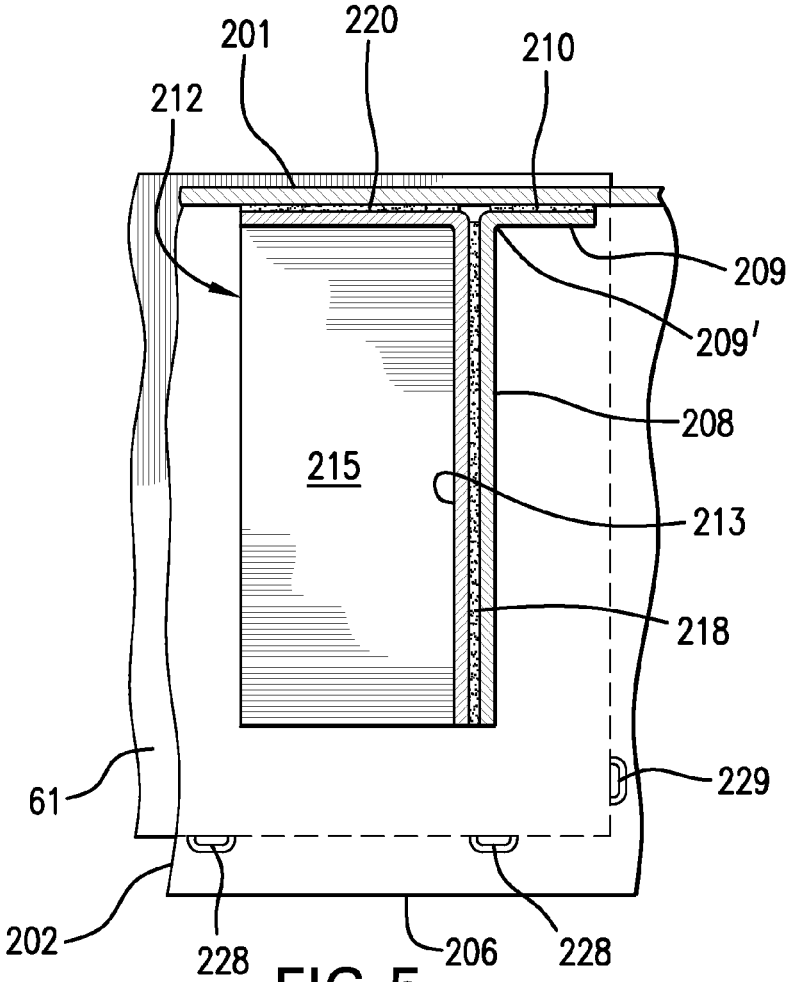
FIG. 5 is a sectional view taken along line 5-5 of FIG. 4.
Figure 7:
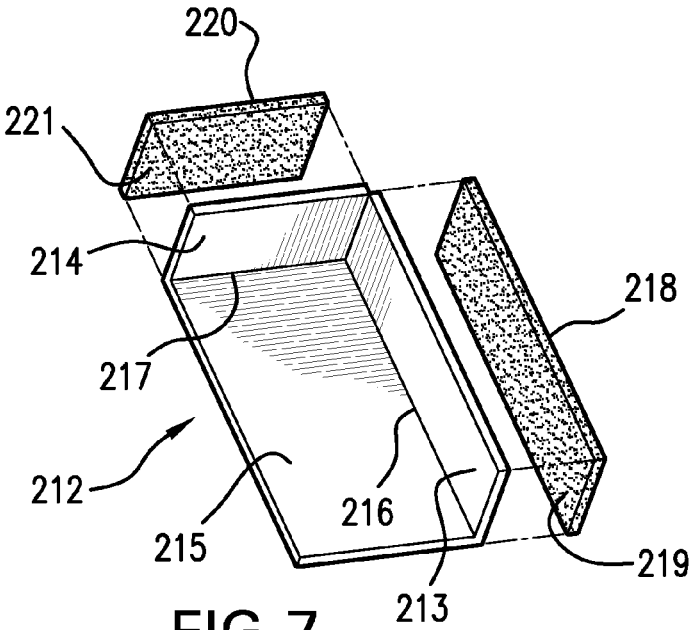
FIG. 7 is an exploded pictorial view of a hold-down device or member which can be positioned to bear against the top of the tag stack.
Figure 6:
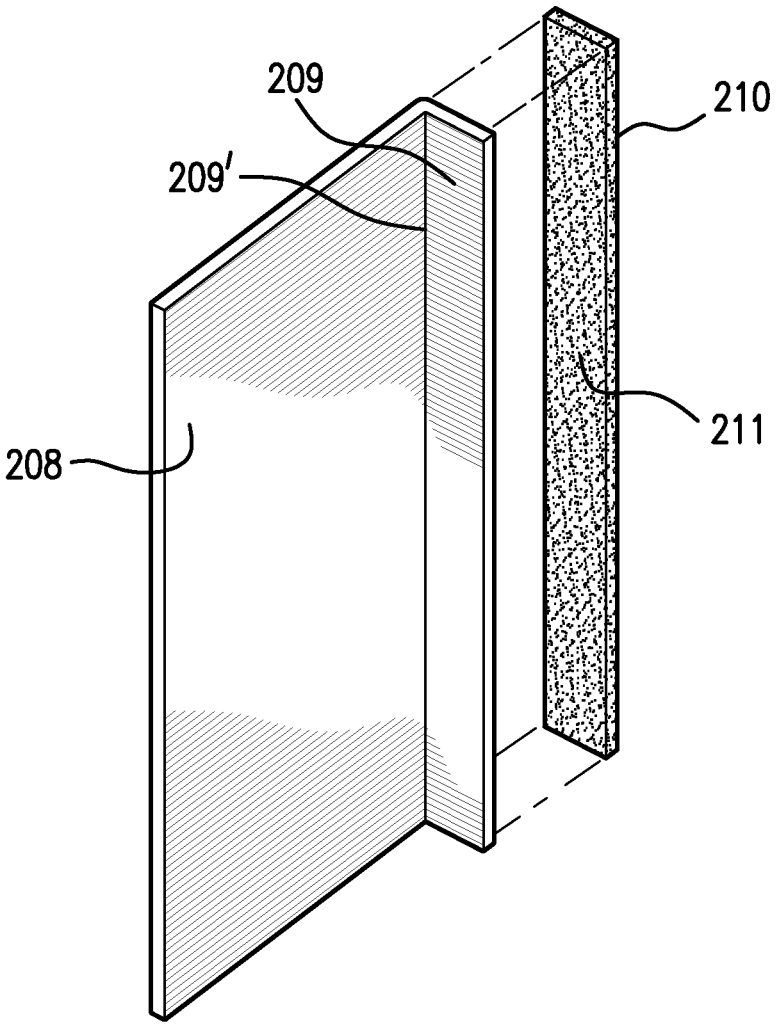
FIG. 6 is an exploded pictorial view of a panel which can form part of the stack tray.
Figure 8:
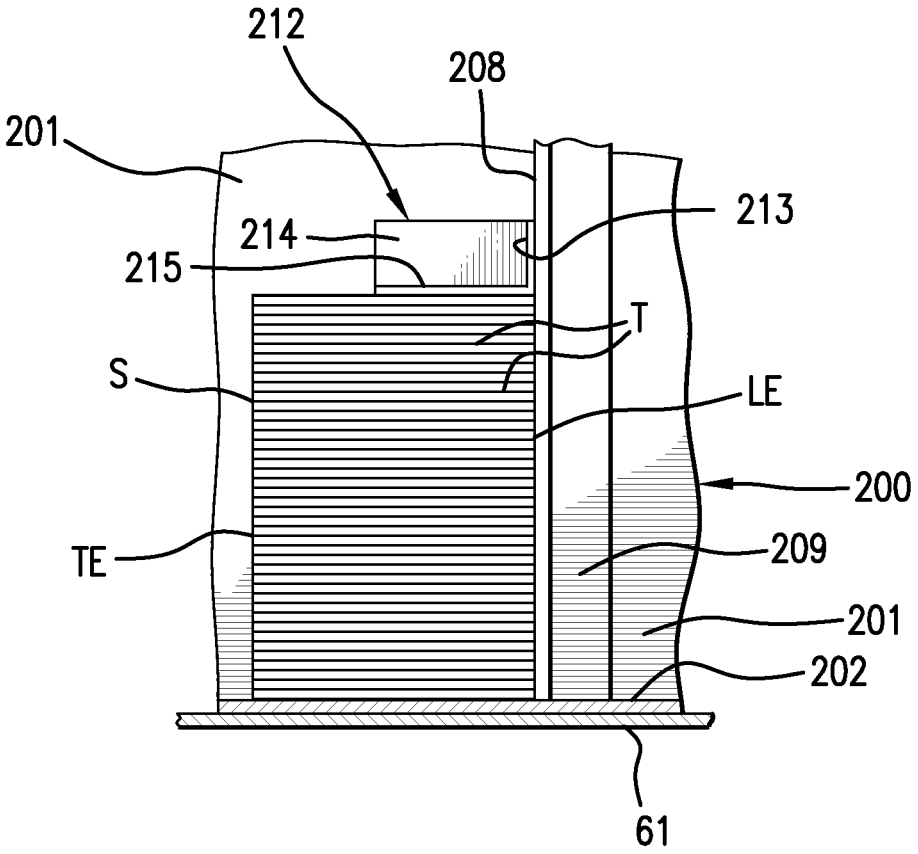
FIG. 8 is an elevational view showing a stack of tags on a bottom panel, when the tag stack is held or clamped between the bottom panel and the hold-down device.

An upstanding side panel or wall 208 preferably extends perpendicularly to the rear panel 201 and to the bottom panel 202. The side panel 208 has a flange 209 extending preferably at a right angle to the panel 208 from a bend line 209'. The side panel 208 is preferably perpendicular to the bottom panel 202. As best shown in FIGS. 5 and 6, a magnetic strip 210 is secured to the flange 209 preferably by an aggressive permanent adhesive 211. Even though the side panel 208 is preferably perpendicular to the bottom panel 202 and the rear panel 201, the side panel 208 can be magnetically attached to the rear panel at any selected angular orientation.

With reference to, for example, FIGS. 4, 5, 7 and 8, there is shown a hold-down device or member generally indicated at 212. The device 212 is shown to have a side panel 213 and a back panel 214 connected to a bottom panel 215 at respective fold lines 216 and 217. The side and rear panels 213 and 214 are preferably disposed at right angles to each other and to the bottom panel 202. The panels 213, 214 and 215 are preferably formed from one piece of sheet metal by bending up panels 213 and 214 with respect to the bottom panel 215. A magnet 218 preferably in the form of a magnetic strip is adhered to the outside of the side panel 213 by an aggressive permanent adhesive 219, and a magnet 220 preferably in the form of a magnetic strip is adhered to the outside of the rear panel 214 by an aggressive permanent adhesive 221. Instead of one magnet 218 for the side panel 213 and one magnet 220 for the rear panel 214, multiple spaced magnets or magnetic strips can be provided. The magnets 218 and 220 can, of course, be adhered to their respective panels by any other suitable means, such as by fasteners.

In use, the stack tray 200 can be simply seated or rested on the platform 61. Tags T can be dispensed toward the side panel 208 and accumulate on the bottom panel 202. As the tags T accumulate, the platform 61 can be lowered so that the tags T continue to be able to be deposited on the top of the stack S. It should be noted that it is not necessary that some or all of the tags T reach the side wall 208. When the desired number of tags has accumulated in a stack S which rests on the bottom panel 202, the stack tray 200 is ready to be removed. The user may lift the tray 200 out of the stacker 51 and tilt the tray 200 so that the tags T gravitate against the side panel 208. The user can actually assist by tamping on the trailing ends TE of the tags T to push the leading ends LE of the tags T against the side panel 208 to form a neater stack S. With the tags T vertically aligned, the user can manually slide the hold-down device 212 downwardly from the upper, normally out-of-use position shown in FIG. 1. In that the magnets 218 and 220 hold securely to the panels 213 and 214, the hold-down device 212 can be slid along the rear and side panels 201 and 208 without dislodging the magnets 218 and 220 from the remainder of the hold-down device 212. Accordingly, the hold-down device 212 can be slid down into contact with the top most tag T in the stack S. Preferably the hold-down device 212 is pressed against the stack S to slightly compress or clamp the stack S so that while the tray 200 and the stack S are transferred to the place where the tags T are to be used, the stack S is held firmly as a stack to eliminate the possibility of the stack S being dislodged or falling out of the tray 200.

Figure 2:
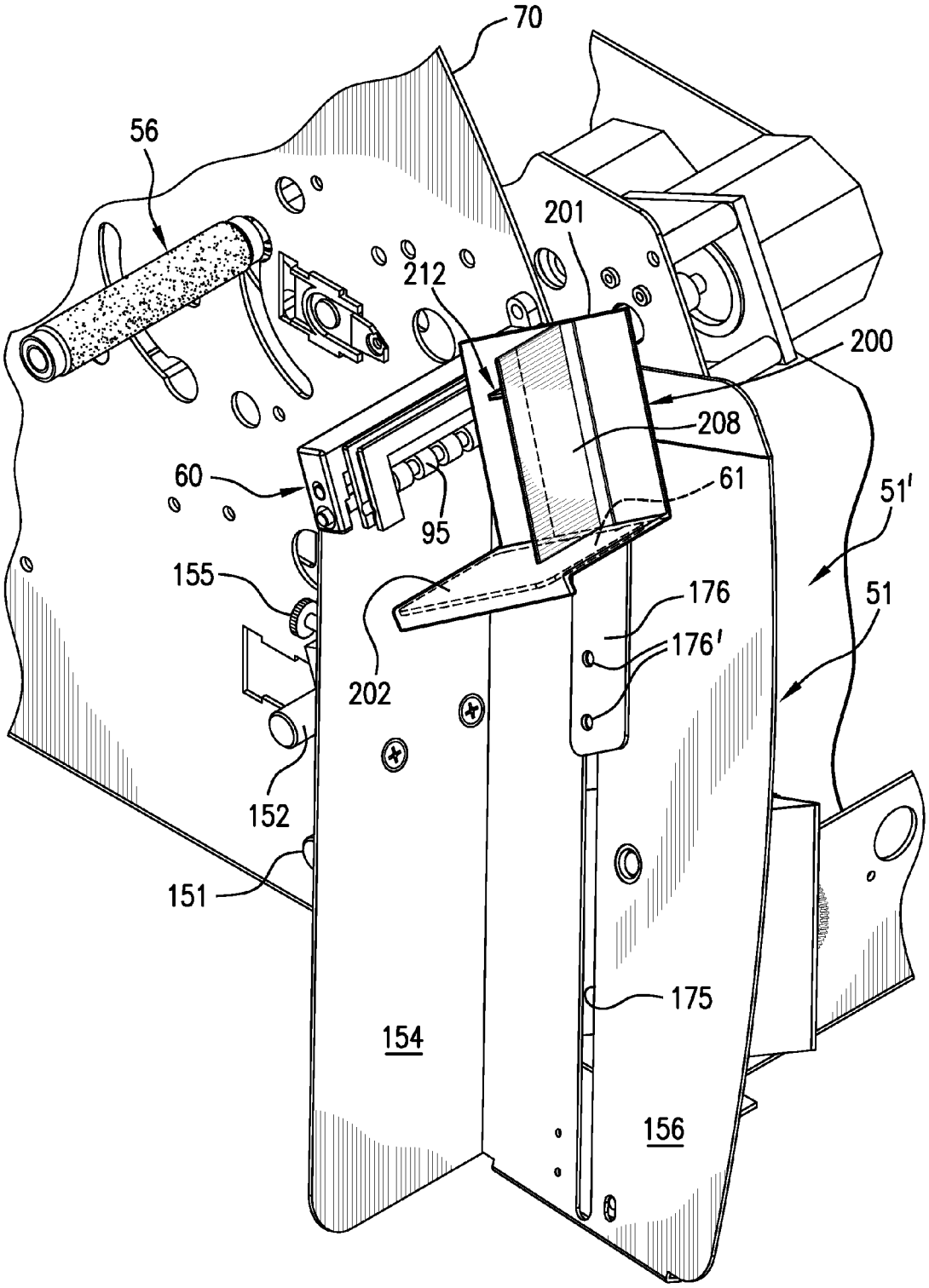
FIG. 2 is a pictorial view of a fragmentary portion of the printer and the tag stacker with the stack tray.
Figure 3:
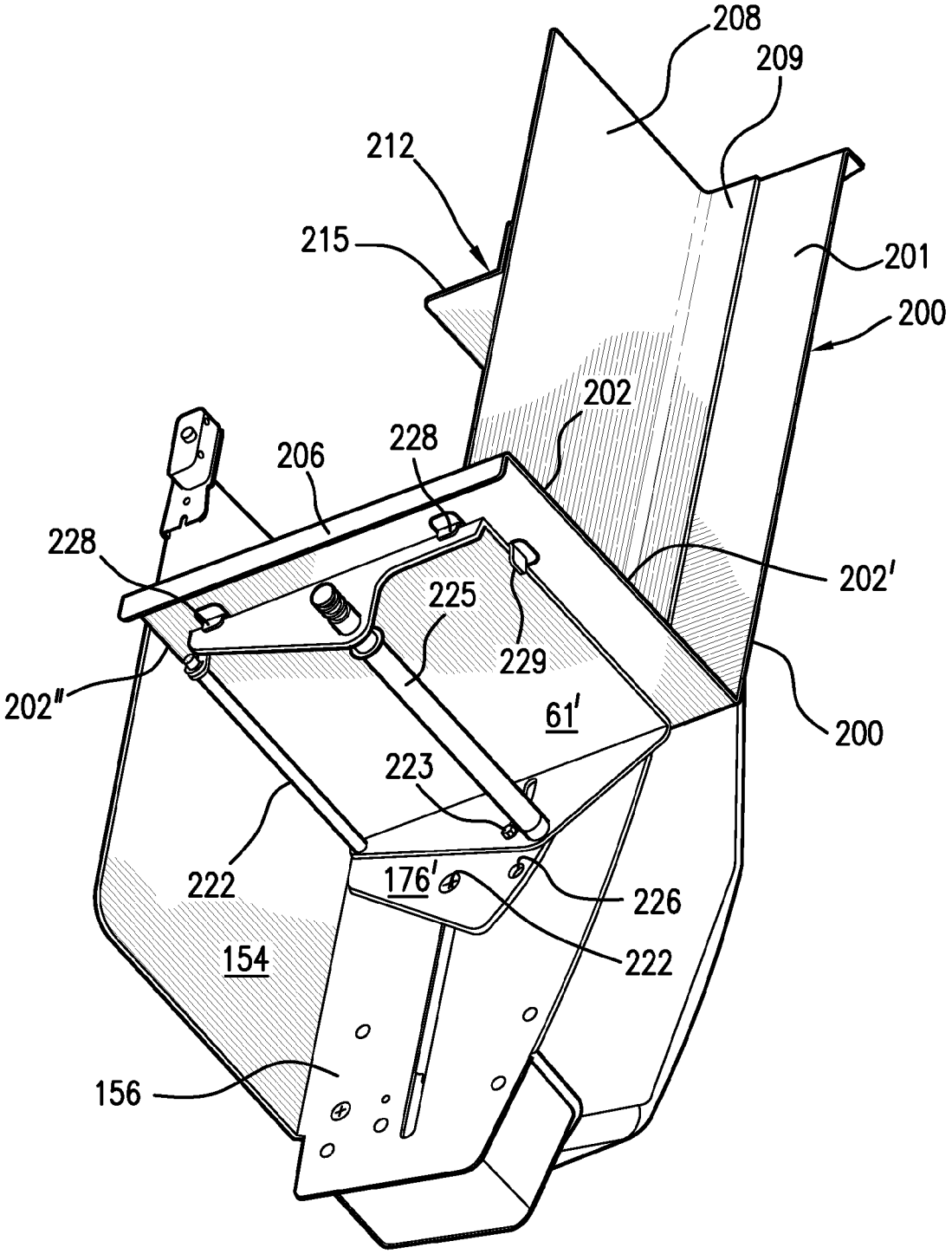
FIG. 3 is a pictorial view showing a platform of the stacker supporting the stack tray.

FIG. 3 shows slightly different version of the platform than the platform 61 shown in FIGS. 1 and 2 and accordingly it is indicated at 61'. The angle of the platform 61' is adjustable about a post or pivot 222. The pivot is secured in a plate 176' like the plate 176. A spring-urged plunger 225 can be pulled outwardly and positioned in one of several holes 226, (only one of which is shown) to adjust the angle of inclination of the platform 61'.

As best shown in FIG. 3, the bottom panel 202 of the stack tray 200 has two spaced apart bent-down tabs 228 at the front adjacent the flange 206, and one bent-down tab 229 adjacent an end 202' of the bottom panel 202. The tabs 228 and 229, referred to generally as "locators", assist in locating the bottom panel 202 and hence the tray 200 on and with respect to the platform 61 or 61'. When thus located, the side edge 202" terminates short of the side wall 154 so as not to rub on the side wall 154 as the platform 61 or 61' moves up or down. Likewise, the rear panel 201 terminates short of the rear wall 156 of the stacker 51 so that the rear panel 201 cannot rub on any part of the rear wall 156.

While a magnet 218 is shown attached to the front panel 213 and a magnet 220 is attached to the rear panel 214 as is preferred, only the side 213 panel or only the rear panel 214 needs to be equipped with a magnet to hold the stack tray 212 in the selected position. It is apparent that the magnets 210 and 220 require that the rear panel or at least a part thereof be comprised of magnetizable or magnetically responsive material, such as steel. Likewise, it is apparent that the magnet 218 requires that the front panel or at least a part thereof be comprised of magnetizable or magnetically responsive material, such as steel.

While the platforms 61 and 61' are disclosed as being movable, the stack tray 200 is also useful with a stacker having a fixed platform.

While the various panels 201, 202, 208, 213, 214 and 215 are illustrated as being rectangular, they can have other shapes.

Other embodiments and modifications of the invention will suggest themselves to those skilled in the art, and all such of these as come within the spirit of this invention are included within its scope as best defined by the appended claims.

We claim:

1. A stacking system, comprising:

a stacker having a movable platform for supporting a stack, a depending mounting member that can be raised and lowered in a vertical direction to thereby raise and lower the platform, wherein the stacker receives tags including magnetizable material; and a stack tray removably supported on the stacker, the tray including an upstanding rear panel and a bottom panel connected to the rear panel, the bottom panel being capable of being supported on the platform, and the bottom panel being capable of accumulating a stack of tags, the stack tray further comprising a repositionable side wall perpendicular to the bottom panel having a flange with a magnet such that the side wall is magnetically attached to the rear panel to hold the side wall in a desired position on the bottom panel supported on the platform.

2. The stacking system as defined in claim 1, wherein the tray includes a positionable side panel toward which the tags can be fed, and wherein the side panel is magnetically attached to the rear panel.

3. The stacking system as defined in claim 2, including a tag hold-down device repositionably attached to one or both of the side and rear panels.

4. The stacking system as defined in claim 1, including a tag hold-down device repositionably attached to the tray.

5. The stacking system as defined in claim 1, including a side panel toward which the tags can be fed, and a tag hold-down device magnetically attached to one or both of the side and rear panels.

6. The stacking system as defined in claim 1, including a side panel repositionable at a selected position with respect to the rear panel.

7. The stacking system as defined in claim 1, including one or more locators on the tray to locate the tray on the platform.

* * * * *